US005490605A

United States Patent [19]

Cutts

[11] Patent Number: 5,490,605

[45] Date of Patent: Feb. 13, 1996

[54] FLOATING ROOF STORAGE TANK

[76] Inventor: William T. Cutts, 14814 Cedar Isle Dr., Houston, Tex. 77084

[21] Appl. No.: 263,606

[22] Filed: Jun. 20, 1994

[51] Int. Cl.[6] ..... B65D 87/18; B65D 88/40

[52] U.S. Cl. ..... 220/211; 220/216; 220/220

[58] Field of Search ..... 220/211, 216, 220/220, 262; 292/33; 49/449

[56] References Cited

U.S. PATENT DOCUMENTS

| | | | |
|---|---|---|---|
| Re. 29,270 | 6/1977 | Nelson | 220/220 |
| 3,319,329 | 5/1967 | Knutsen et al. | 220/220 X |
| 3,583,594 | 6/1971 | Belanger et al. | 220/220 |
| 3,815,775 | 6/1974 | Strunc et al. | 220/220 |
| 4,036,394 | 7/1977 | Bodley et al. | 220/222 |
| 5,230,436 | 7/1993 | Vaughn | 220/220 |
| 5,305,904 | 4/1994 | Cutts | 220/220 |
| 5,353,941 | 10/1994 | Benvegnu et al. | 220/220 |

*Primary Examiner*—Gary E. Elkins

*Attorney, Agent, or Firm*—Bill B. Berryhill

[57] ABSTRACT

An improved storage tank of the type having a bottom, side walls and a floating roof in which the improvement comprises support legs and support sleeves for selectively supporting the floating roof at first and second elevations. The support legs engage the tank bottom and extend upwardly therefrom. The support sleeves are attached to the floating roof and extend downwardly therefrom. The support sleeves surround the support legs and are vertically moveable relative thereto from first positions in which the support sleeves engage the tank bottom to support the floating roof at the first elevation and second positions in which the floating roof may be supported by the support legs at the second elevation. Attached to the support sleeves is a locking member which is horizontally moveable between an unlocked position, permitting unrestricted vertical movement of support sleeves relative to the support legs, and a locked position engageable with the support legs, when the floating roof is at the second elevation, to prevent downward vertical movement of said support sleeves, supporting the floating roof on the support legs.

11 Claims, 5 Drawing Sheets

FLOATING ROOF STORAGE TANK

BACKGROUND OF THE INVENTION

1. Field of the Invention

The present invention pertains to fluid storage tanks. More particularly, the present invention pertains to storage tanks of the type having a floating roof. Specifically, the present invention pertains to a floating roof storage tank in which the floating roof may be supported at more than one elevation above the bottom of the tank, independently of fluid in the tank.

2. Description of the Prior Art

Many types of fluids are stored in tanks having a bottom, vertical sidewalls and a roof. Many tank roofs are fixed. However, other tanks are provided with floating roofs which cover the stored fluid and ride up and down on the fluid surface therein in response to changes in volume of fluids within the tank. Accordingly, vapor space within the tank is kept at a minimum. This reduces the loss of fluids from evaporation and reduces the hazards associated with vapors, particularly hydrocarbon vapors.

The floating roof of a floating tank is typically constructed of-metal sheets welded together to form a circular deck with a rim around its edge to prevent fluids stored in the tank from escaping from beneath the floating roof. Most, if not all, floating roof tanks are provided with some type of roof support which allows the floating roof to be supported at some elevation above the bottom of the tank when there is little or no fluid therein. There is normally a minimum elevation in which the roof should be supported to prevent it from being positioned below tank inlets or outlets since allowing the roof to do would result in the roof's sinking if additional fluid enters the tank through the inlets or outlets. At other times, it is desirable to support the floating roof at even higher elevations to provide enough room below the floating roof for workers performing, cleaning, painting or other service operations. This allows both personnel and equipment easy access under the roof for performing these operations. In addition, the work may be carried out in a much safer manner.

Typically, storage tanks with conventional floating roofs are constructed with support legs which support the floating roof at a predetermined elevation from the bottom of a tank. Due to the desire to be able to support the roof at some higher position above the tank bottom, floating roof tanks have been constructed in which support sleeves, typically made of pipe, are attached to the roof and extend both downwardly and upwardly therefrom for telescopic engagement with a second smaller diameter pipe. Pins are used to pin the two pipes so that the roof may be supported at different elevations. Of course, this results in several openings through the roof. These openings do not leak liquids due to the support sleeve acting as a well. However, such openings do contribute to vapor loss and subject personnel, repositioning the legs at different elevations, to exposure from vapors and products stored in the tank.

Additional developments have been made in floating roof tanks in which the floating roof may be supported from a fixed roof by support means which are activatable through access openings in the fixed roof. Examples of such may be seen in U.S. Pat. Nos. 3,815,775 and 3,831,800. However, these types of supports require a fixed roof, access therethrough and positioning of personnel on top of the tank for operation thereof. Other developments have been made to support the floating roofs at different elevations by means of rotating the floating roof and alignment of two sets of legs as shown in U.S. Pat. No. 5,305,904. This system requires rotation of the floating roof.

SUMMARY OF THE PRESENT INVENTION

In the present invention, an improved fluid storage tank of the type having a bottom, sidewalls and a floating roof is disclosed in which the floating roof may be selectively supported at first and second elevations above the bottom of the tank independently of fluid therein. The support is provided by supporting apparatus which includes a plurality of support legs engaging the tank bottom and extending upwardly therefrom and a plurality of support sleeves attached to the floating roof and extending downwardly therefrom. The support sleeves preferably surround the support legs and are vertically moveable relative thereto from first positions in which the support sleeves engage the tank bottom to support the floating roof at a first elevation and a second position in which the floating roof may be supported by the support legs at a second elevation.

A locking assembly carried by the floating roof may include a locking member and a power device attached thereto. The locking member is moveable by the power device between an unlocked position, permitting unrestricted vertical movement of the support sleeves relative to the support legs, and a locked position engageable with the support legs, when the floating roof is at its second elevation, preventing downward vertical movement of the support sleeves and supporting the floating roof by the support legs in the second elevation. The locking means may comprise pins or plate members which are horizontally moveable by the power device for engagement with an uppermost end of the support legs when the floating roof is at the second elevation.

In preferred embodiments of the invention, the support sleeves are tubular and extend through the floating roof to provide a vertical hole through which the support legs may extend above the floating roof. Seal means are attached to the support sleeves for sliding and sealing engagement with the support legs to prevent loss of fluids from beneath the floating roof.

Thus, the improved fluid storage tank of the present invention provides a floating roof which may be safely supported at two elevations above the bottom independently of fluid therein, and with a minimum loss of vapors from the stored fluids. Many other objects and advantages of the invention will be understood from reading the description which follows in conjunction with the accompanying drawings.

DESCRIPTION OF THE PREFERRED EMBODIMENTS

Figure 1:
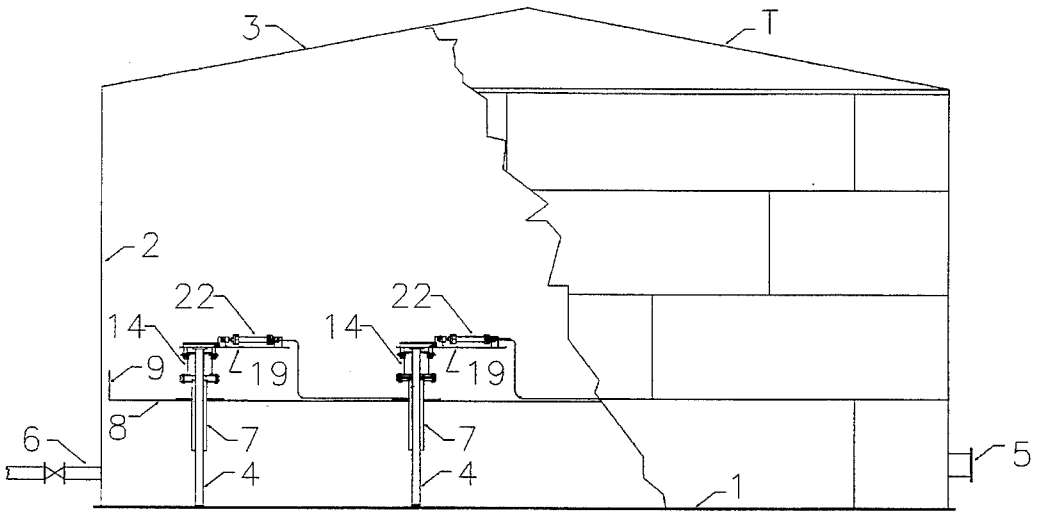
FIG. 1 is an elevation view, partially broken away and in section, of an improved fluid storage tank of the floating roof type, according to a preferred embodiment of the invention.

Referring first to FIG. 1, there is shown a metallic tank T having a substantially flat bottom 1, cylindrical vertical sidewalls 2 and an optional fixed conical roof 3. The cylindrical sidewalls 2 may be formed by welding sections of metal plate in the form of a cylinder. Miscellaneous inlets 6, outlets (not shown) and manholes 5 may be located in the sidewalls 2 of the tank T.

Disposed within the tank T for movement therein is a floating roof which includes a circular deck 8 and an upwardly projecting metallic rim 9. When fluids are stored in the tank T, beneath the floating roof 8, the floating roof 8 floats upwardly and downwardly on the surface of the fluid stored therein. The rim 9 prevents the fluid from escaping from under the floating roof to the upper side thereof.

Figure 2:
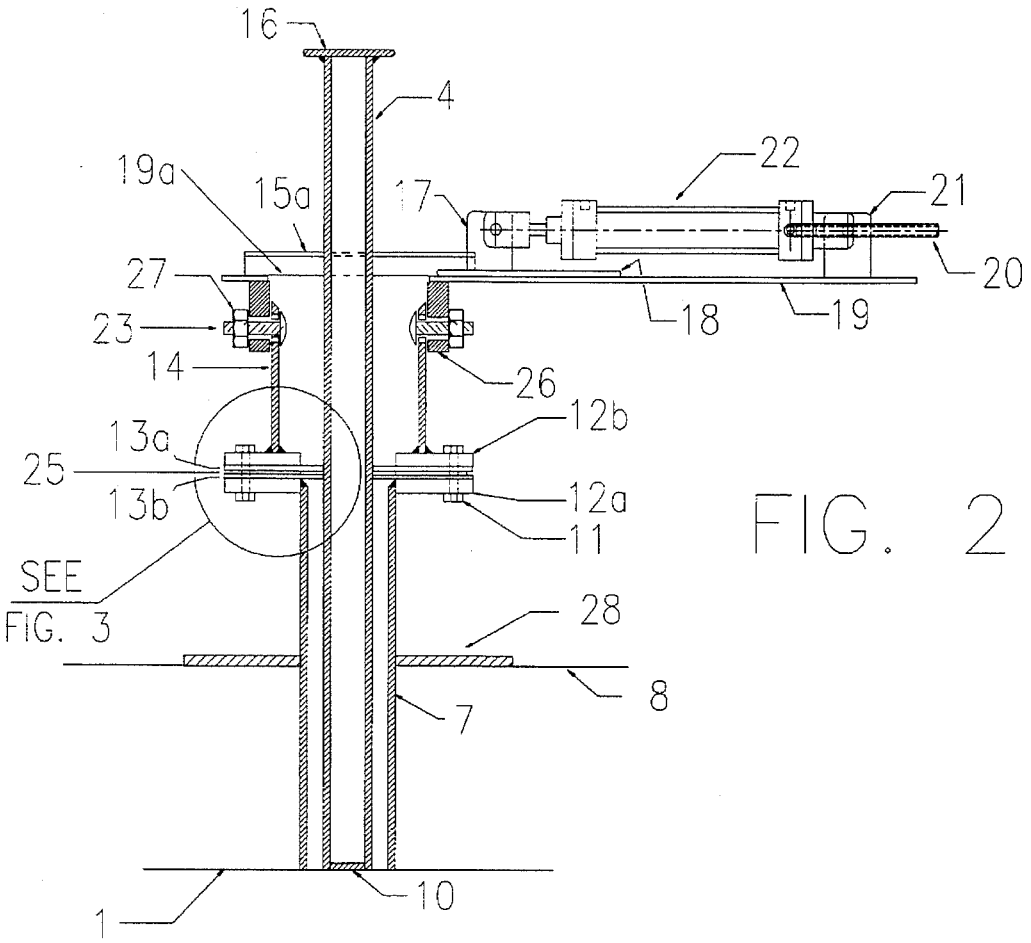
FIG. 2 is a detailed sectional view of support means for supporting the floating roof of the tank of FIG. 1, the floating roof being at a first or lower elevation, according to a preferred embodiment of the invention.
Figure 5:
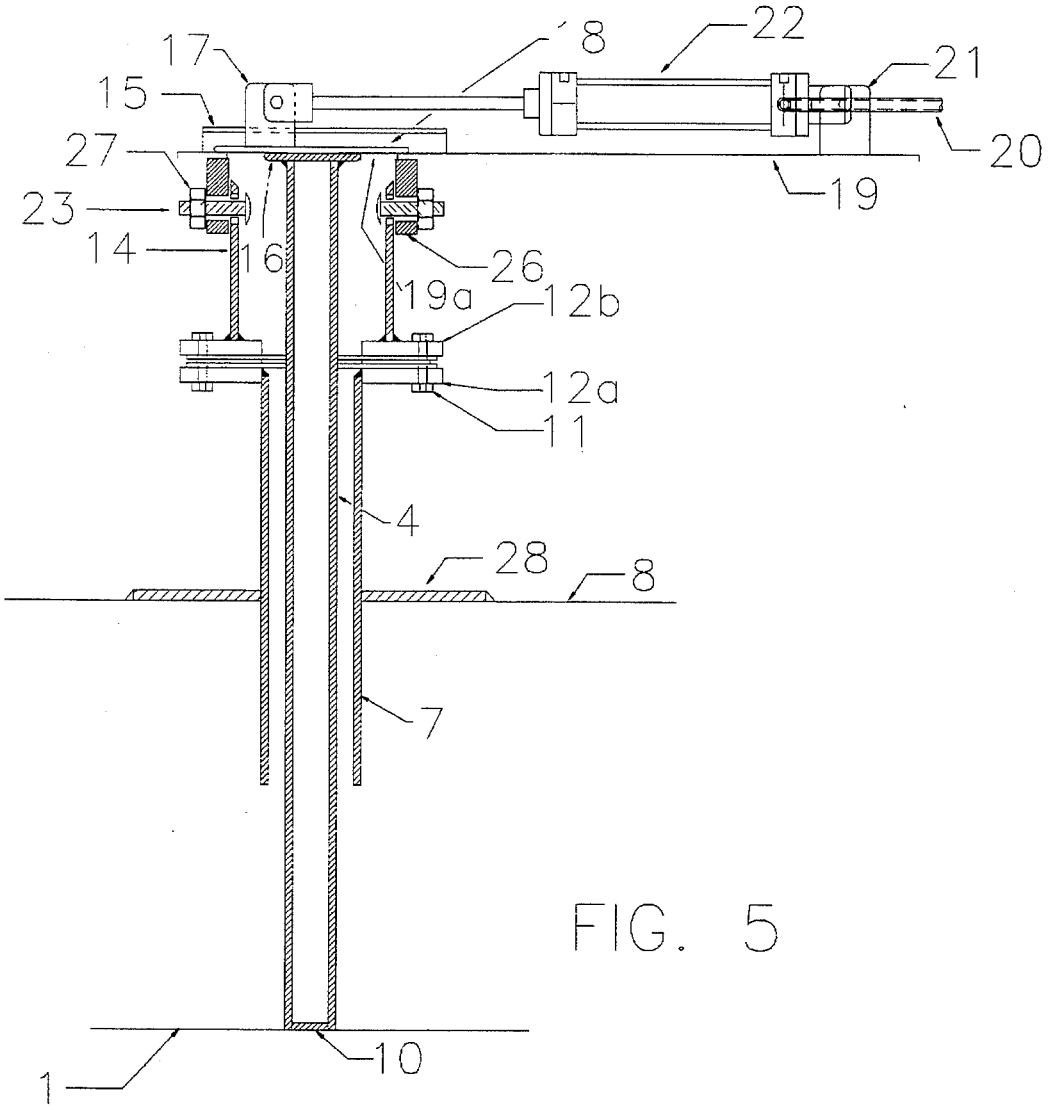
FIG. 5 is a detailed sectional view of support apparatus of the present invention, similar to FIG. 2, but showing the floating roof supported at a second and higher elevation, according to a preferred embodiment of the invention.

Referring also to FIGS. 2 and 5, a plurality of support legs 4 engage the bottom 1 of the tank T and extend upwardly therefrom. The legs 4, which may be conveniently made from pipe, may be provided with an upper cap 16 and a lower closure 10 to prevent entry of any of the fluid contents of the tank T.

Projecting downwardly from the floating roof 8 is a plurality of support sleeves 7 which are preferably welded to the floating roof deck 8. The support sleeves 7, preferably of tubular pipe, extend through the floating roof deck 8 to provide a vertical hole or well through which the support legs 4 may extend above the floating roof deck 8. A reinforcing pad 28 may be welded to the roof deck 8 around sleeves 7. Unless prevented from doing so, the support sleeves 7 are vertically moveable relative to the support legs 4 from a first position, such as in FIG. 2, in which the support sleeves engage the bottom 1 of the tank T to support the floating roof at a first elevation, and second positions, such as illustrated in FIGS. 1 and 5, in which the floating roof may be supported by the support legs 4 at a second higher elevation, as will be more fully understood hereafter.

Since the tank bottom 1 may be sloped, each pair of support legs 4 and support sleeves 7 may not be exactly equal in length. For practical purposes, they may be said to be substantially equal in length. The support legs 4 and support sleeves 7 are provided in adequate numbers and at predetermined locations sufficient to support the full weight of the floating roof even when no fluids are contained in the tank under the roof.

Figure 3:
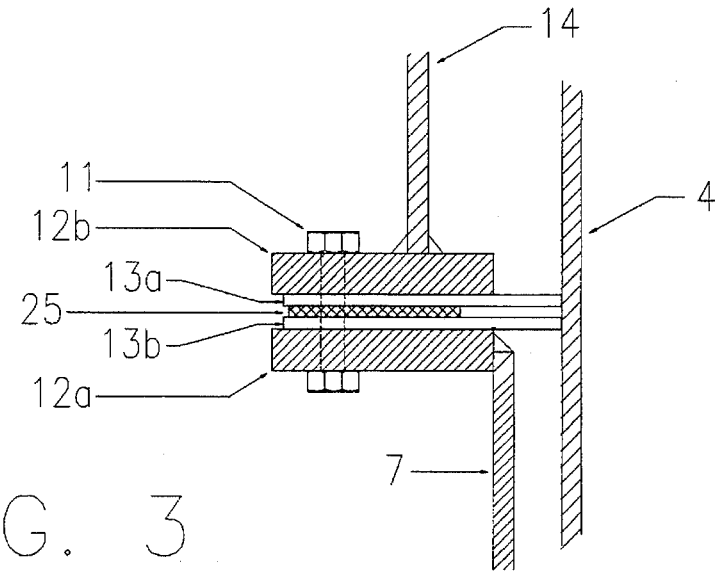
FIG. 3 is a detailed partial sectional view of seal means utilized with the support apparatus of FIG. 2, according to a preferred embodiment of the invention.

Welded to the upper ends of each support sleeve 7 is a flange **12*a*. Attached to flanges 12*a* by bolts 11 is another flange 12*b*. Sandwiched between flanges 12*a* and 12*b* are a pair of sealing gaskets 13*a*, 13*b* separated by a spacer 25. The sealing gaskets 13*a*, 13*b* are annular in shape and extend inwardly from between flanges 12*a*, 12*b* for sliding and sealing engagement with the outer diameter of support legs 4 as best seen in FIG. 3. The sealing gaskets 13*a*, 13*b* and spacer 25 act to retard and prevent fluid product vapor from escaping from under the floating roof deck 8 through the annular area between support legs 4 and support sleeves 7**.

Welded to the upper flange **12*b* is a large diameter tubular member 14 having radial holes for receiving bolts 23 which extend radially outward through corresponding holes in a hub 26 for engagement by nuts 27. The hub 26 supports a horizontal plate 19 to which components of locking apparatus may be attached. The support plate 19 is provided with a hole 19*a* therein which is concentrically disposed around the support leg 4 providing enough clearance for the support sleeve 7 and the tubular member 14 surmounted thereon to move vertically upwardly and downwardly, relative to the support leg 4, without interference with the leg 14 or the cap 16** at the upper end thereof.

Figure 4:
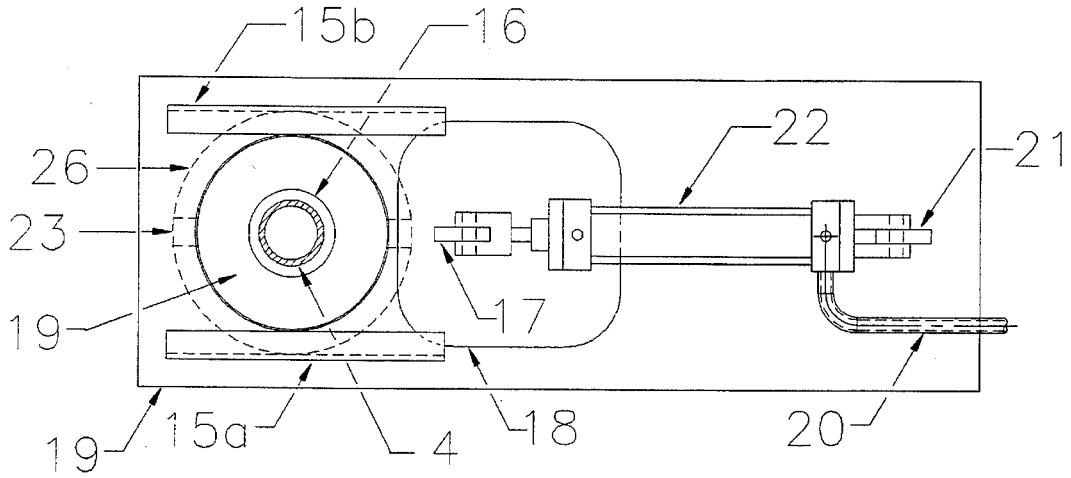
FIG. 4 is a detailed plan view, showing the attachment of power and locking means utilized in support apparatus of FIGS. 1 and 2, according to a preferred embodiment of the invention.

As best seen in FIGS. 2, 4 and 5, the locking apparatus includes a power device 22, which in the exemplary embodiment is a double acting (push/pull) air or hydraulic piston and cylinder (or ram) device connected to a source of pressurized fluid and/or gas through conduits 20. One end of the ram power device 22 is affixed to the plate 19 by a supporting clip 21. The opposite moveable end of the ram 22 is attached by a clip 17 to a moveable plate 18.

Attached on opposite sides of the hole **19*a* are a pair of angle members 15*a*, 15*b*. As best seen in FIG. 4, the angle members 15*a*, 15*b* are long enough to overlie the edges of plate 18 and provide guides for movement of the plate 18 from the position of FIGS. 2 and 4 4 to a second position, such as illustrated in FIG. 5, in which the plate 18 lies over the hole 19*a* and the cap 16 at the upper ends of leg support 4. Of course, the floating roof deck 8 must be in the second higher elevation of FIGS. 1 and 5 to allow the plate member 18 to move to this position. In the second position of FIG. 5, the plate 18, due to engagement with the angles 15*a* and 15*b* engages the cap 16 to support the floating roof deck 8 at its second and higher elevation as illustrated in FIG. 5**.

Figure 7:
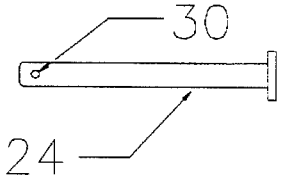
FIG. 7 is a detailed longitudinal view of a pin member which forms a portion of the support apparatus of FIG. 6, according to an alternate embodiment of the invention.
Figure 6:
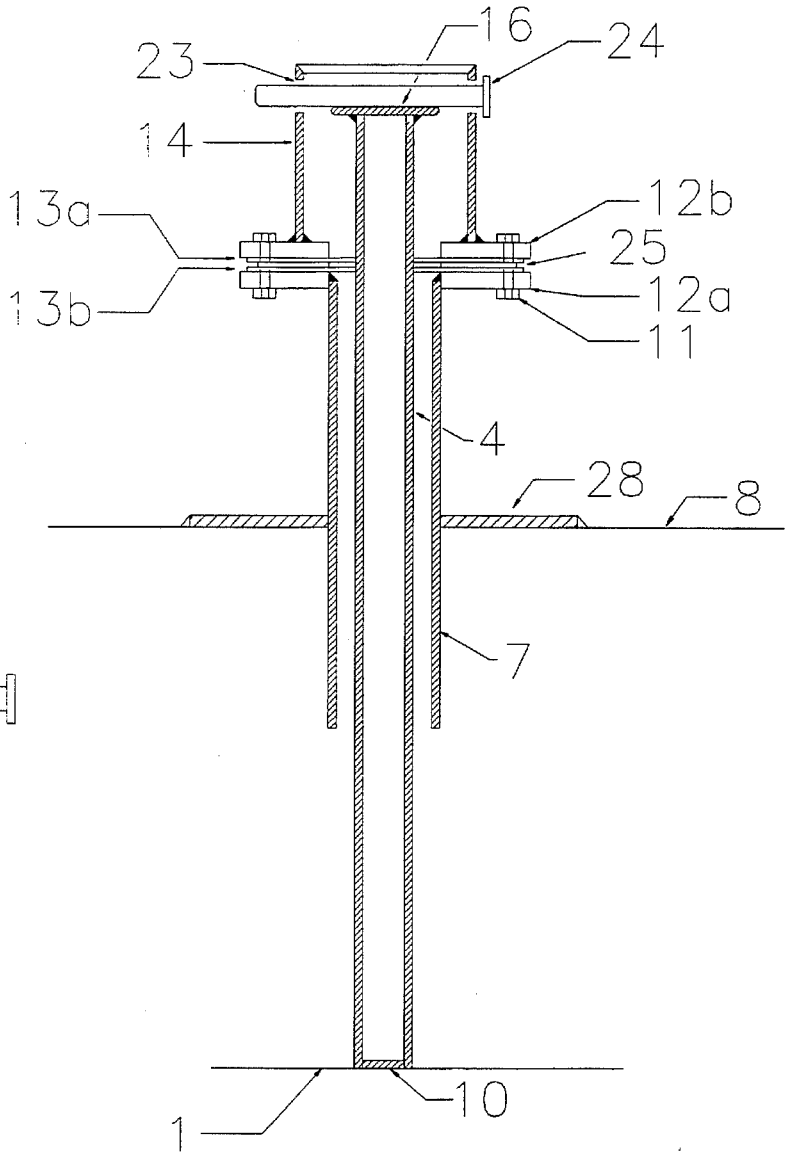
FIG. 6 is a detailed sectional view of support apparatus for supporting the floating roof of a floating roof tank at first and second elevations, according to an alternate embodiment of the invention.

FIGS. 6 and 7 illustrate another embodiment of the invention in which the locking apparatus, supplied by the power device 22 and plate 18 of FIGS. 1–5, are replaced by a simpler manual locking pin. In this version, coaxially aligned holes 23 are provided through the tubular member 14 for receiving a pin 24, the pin 24 may be inserted through these holes 23, when the floating roof deck 8 is at the second higher elevation so that the pin 24 would then engage the pad 16 at the upper most end of support legs 4 to support the floating roof at the second higher elevation. A hole 30 could be placed through the end of the pin 24 for receiving a key or pin to prevent dislodgement of the pin 24. The pin 24 could be connected to one end of a power ram, such as ram 22 in FIGS. 1–5, for remote operation.

Referring now to FIGS. 1–5, it can be easily understood that the floating roof 8 would float downwardly, upon removable of fluids from the tank T, until the support sleeves 7 engage the bottom 1 of the tank T. The support sleeves 7 would then support the floating roof at a first and lowermost elevation, as in FIG. 2, even if there were no fluids in the tank T. This prevents the floating roof from moving lower than the inlet 6 and outlets (not shown) so that fluids may not escape from under the floating roof to the upper side thereof. This prevents the floating roof from sinking to the bottom of the tank T.

However if it is desired to perform certain operations under the floating roof 8, enough fluid may be introduced in the tank to raise the floating roof 8 to an elevation at least as great as the higher second elevation position of FIGS. 1 and 5. At this point the locking apparatus, including the ram 22, may be activated causing the plate 18 to slide from its first position of FIGS. 2 and 4 to the second position of FIG. 5, overlying the cap 16 at the upper most end of support leg 4. The locking plate 18 would then prevent the floating roof 8 from moving any lower than the second elevation of FIGS. 1 and 5 even if all the fluids are evacuated from underneath the floating roof 8.

After cleaning or other kinds of operations are performed in the tank, fluids may be reintroduced into the tank T causing the floating roof to float on the fluids therein and be supported invention is uniquely provided with a plurality of support sleeves thereby sufficiently to allow the plate 18 to be retracted by ram 22 so that the roof is no longer supported by the support legs 4. The floating roof can then float between any upper positions in the tank T and its lowermost position supported on the support sleeves 7 as in FIG. 2.

Thus, the improved fluid storage tank of the present invention is uniquely provided with a plurality of support sleeves and corresponding support legs which cooperate to support the floating roof at a first lower elevation and a second higher elevation. This is accomplished with unique locking apparatus and with seal apparatus which will provide sealing engagement between the support legs and support sleeves to prevent loss of vapors and other fluids from underneath the floating tank. The first elevation is one in which the floating roof is supported above the tank bottom but prevented from sinking to the bottom of the tank in the absence of fluids therein. The second elevation at which the roof is supported is high enough to permit personnel and equipment to enter the tank for cleaning, painting or other maintenance operations with plenty of room and safety for such operations.

At least two embodiments of the invention have been described herein. However, many variations can be made without departing from the spirit of the invention. Accordingly, it is intended that the scope of the invention be limited only by the claims which follow.

I claim:

1. An improved storage tank of the type having a bottom, side walls and a floating roof in which the improvement comprises support means for selectively supporting said floating roof at first and second elevations above said bottom, said support means comprising:

a plurality of support legs engaging said bottom and extending upwardly therefrom;

a plurality of support sleeves attached to said floating roof and extending downwardly therefrom, said support sleeves surrounding said support legs and being vertically moveable relative thereto from first positions in which said support sleeves engage said bottom to support said floating roof at said first elevation and second positions in which said floating roof may be supported by said support legs at said second elevation; and locking means attached to said support sleeves comprising a locking member horizontally moveable between an unlocked position, permitting unrestricted vertical movement of said support sleeves relative to said support legs, and a locked position engagable with said support legs, when said floating roof is at said second elevation, to prevent downward vertical movement of said support sleeves and to support said floating roof by said support legs in said second elevation.

2. An improved floating roof storage tank as set forth in claim 1 in which said support legs are of substantially equal length, said support sleeves being of substantially equal length but of a length less than said support legs.

3. An improved floating roof storage tank as set forth in claim 1 including sealing means carried by said support sleeves and slidingly engageable with said support legs to prevent loss of fluids from beneath said floating roof.

4. An improved floating roof storage tank as set forth in claim 1 in which said locking means comprises power means affixed to said locking member and being remotely activatable to move said locking member between said unlocked and said locked positions.

5. An improved floating roof storage tank as set forth in claim 4 in which said locking member comprises a horizontal plate engageable with corresponding horizontal surfaces fixed to said support sleeves, when in said locked position.

6. An improved floating roof storage tank as set forth in claim 4 in which said locking member comprises a pin engageable with a pair of coaxially aligned holes of a member attached to said support sleeves, when in said locked position.

7. An improved storage tank of the type having a bottom, side walls and a floating roof in which the improvement comprises support means for selectively supporting said floating roof at first and second elevations above said bottom, said support means comprising:

a plurality of support legs engaging said bottom and extending upwardly therefrom;

a plurality of support sleeves attached to said floating roof and extending downwardly therefrom, each one of said support sleeves being aligned with a corresponding one of said support legs and vertically moveable, relative thereto, between a first position in which said support sleeves engage said tank bottom to support said floating roof at said first elevation and a second position in which said floating roof may be supported by said support legs at said second elevation; and locking means carried by said floating roof comprising a locking member and power means attached thereto, said locking member being movable by said power means between an unlocked position, permitting unrestricted vertical movement of said support sleeves relative to said support legs, and a locked position engageable with said support legs, when said floating roof is at said second elevation, preventing downward vertical movement of said support sleeves and supporting said floating roof by said support legs at said second elevation.

8. An improved floating roof storage tank as set forth in claim 7 in which said locking member comprises one of a pin and a plate engageable with an uppermost end of said support leg when in each second position.

9. An improved floating roof storage tank as set forth in claim 7 in which said support sleeves are tubular and extend through said floating roof to provide a vertical hole through which said support legs may extend above said floating roof.

10. An improved floating roof storage tank as set forth in claim 9 including seal means carried by said support sleeves for sliding and sealing engagement with said support legs to prevent loss of fluids through said vertical hole from beneath said floating roof.

11. An improved floating roof storage tank as set forth in claim 10 in which said support sleeves and said support legs are cylindrical in cross section, the outer diameter of said support legs being less than the inner diameter of said tubular support sleeves.

* * * * *